United States Patent [19]

Ustin et al.

[11] 4,180,305

[45] Dec. 25, 1979

[54] SECTIONAL ELECTRICAL TERMINAL BLOCK

[75] Inventors: George Ustin, Croton-on-Hudson; Andrew P. Soltis, Yonkers, both of N.Y.

[73] Assignee: North American Philips Corporation, New York, N.Y.

[21] Appl. No.: 896,734

[22] Filed: Apr. 17, 1978

[51] Int. Cl.[2] ..... H01R 9/10; H01R 9/16

[52] U.S. Cl. ..... 339/198 H

[58] Field of Search ..... 174/138 F; 339/113 R, 339/198 R, 198 G, 198 GA, 198 H, 273 F

[56] References Cited

U.S. PATENT DOCUMENTS

| | | | |
|---|---|---|---|
| 3,201,747 | 8/1965 | Blanchet | 339/198 GA |
| 3,212,051 | 10/1965 | Clewes | 339/198 G |
| 3,253,252 | 5/1966 | Piperato et al. | 339/198 |
| 3,474,383 | 10/1969 | Mahon et al. | 339/198 GA |
| 3,800,269 | 3/1974 | Palombella | 339/198 R |

FOREIGN PATENT DOCUMENTS 965475 7/1964 United Kingdom .

OTHER PUBLICATIONS

"Write-On Label", J. W. Mollen, IBM Tech. Disclosure Bulletin, vol. 11, No. 8, Jan. 1969 (pp. 968-969).

*Primary Examiner*—E. F. Desmond

*Attorney, Agent, or Firm*—Algy Tamoshunas

[57] ABSTRACT

A sectional terminal block assembly has identical interlocking sections held together by the electrical elements. Each section has a projecting portion, and a recess portion shaped to receive the projecting portion of an adjoining section, the projecting and recess portions having interlocking shapes to prevent transverse motion or twist. Each contact element has an arm locked in aligned transverse slots in the projecting and recess portions to prevent relative motion longitudinally. A simple plastic cover snaps over the top of barriers between adjacent contact elements, and is pivotal upward from either side to allow access to the contacts.

21 Claims, 6 Drawing Figures

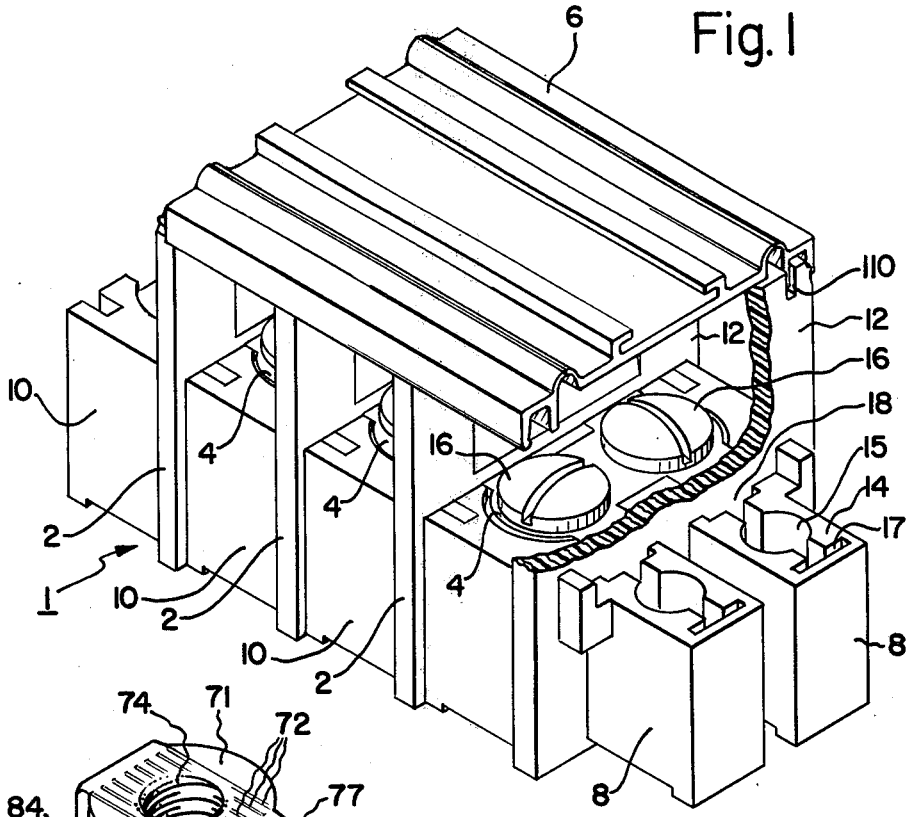
Fig. 1
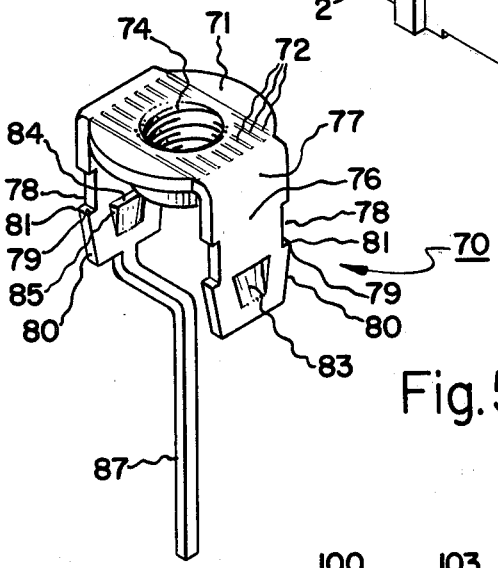
Fig. 5
Fig. 6
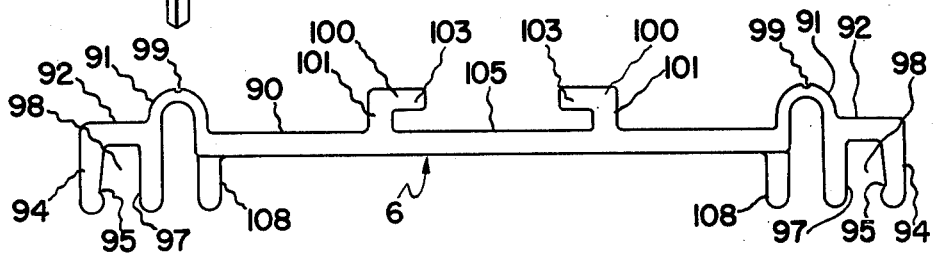

Fig.2
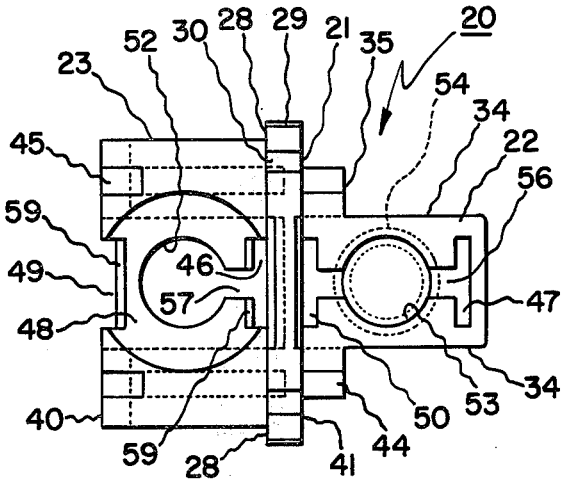
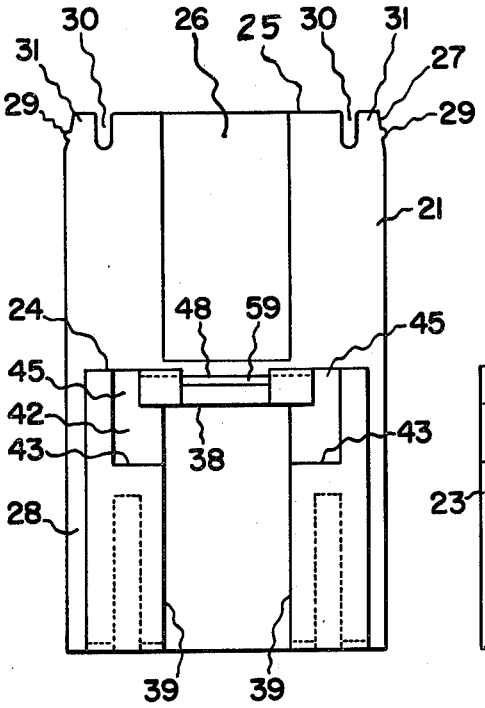
Fig.4
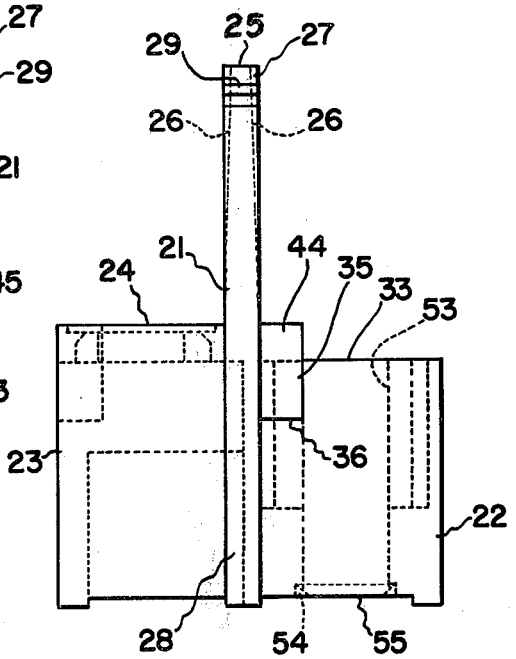
Fig.3

SECTIONAL ELECTRICAL TERMINAL BLOCK

BACKGROUND OF THE INVENTION

1. Field of the Invention

The invention relates to electrical terminal blocks or strips made of a number of interlocking sections, and more particularly to a terminal block formed by a plurality of substantially identical sections interlocked longitudinally, each section providing means for establishing electrical connection to a junction point which is insulated from other electrical connections.

Sectional terminal blocks offer the advantage over one piece constructions in that it is not necessary to stock a large number of differing lengths of strip or block in order to satisfy interconnection requirements having different numbers of junctions. There is the further advantage that not all sections need to be completely identical, so long as they have a common design of interlocking mechanization. Thus, "feed-through" terminals can be intermixed with other styles of connections so that it becomes unnecessary to route certain conductors through a panel, at the same time that it is possible to maintain other electrical circuit points totally to one side of the panel so that there is uninterrupted shielding by the panel from the electrical circuit which is not connected to a feed-through.

In many applications it is important that a sectional terminal block be of substantially the same strength and rigidity as a one-piece block having the same number of connection sections. However, previously known sectional terminal blocks have offered less strength against separation of the sections or flexing of the length of the block than one-piece block constructions.

2. Description of the Prior Art

To provide the benefit of reduced inventory requirements, it has long been known to provide sectional terminal blocks which may readily be assembled to any desired length, where rigidity and strength of the assembled block are assured by the attachment of each of the sections to a length of track. Because the track need not be made of an insulated material, and because it may be fastened to a backing panel at a number of locations, a sectional terminal block such as that described in U.S. Pat. No. 3,293,593 eliminates concern about undue flexing of the assembled block. However, it is clear that if the track is made of a low cost, readily available material such as aluminum or steel, provision of a feed-through terminal connection becomes complicated, and requires that an appropriate size hole or holes be provided in the track.

A different form of sectional terminal block avoids the above described difficulties in providing feed-through connections, when the individual terminal sections rather than being mounted on a track are assembled in a slot in the panel or chassis itself, such as described in U.S. Pat. No. 3,315,215. However, it is clearly more time consuming and difficult to make a slot in the panel equal to the length of the desired terminal block than it is to provide a small number of holes for mounting screws, and in some applications the panel or chassis would not only be greatly weakened by cutting the slot, but a vital shielding effect of the chassis metal material would be lost.

Still another approach to terminal block design is exemplified by U.S. Pat. No. 2,922,139 which describes a block of identical sections, except for the end pieces, which requires neither a track nor a special panel slot.

Mating projections and recesses provide alignment along both transverse axes. A press fit between certain longitudinal projections and the corresponding recess holds the sections together against longitudinal pulling or bowing of the assembled string of sections. However, it is clear that the strength of a long terminal block according to this design is limited by the resistance of the weakest force fit between a pin and a hole in the entire chain of sections. If some technique such as glueing is not utilized, the force required to assemble such a block will probably be substantially greater than the tensile force that the block can withstand.

An additional problem that has been considered is the protection and identification of connections. Because voltages appearing at exposed connections may be hazardous, and inadvertent contact with terminals may cause sensitive circuits to be damaged, removable covers such as shown in the U.S. Pat. No. 3,247,480 have been proposed. This cover has gripping fingers along each edge, arranged to slip over mating bosses on each section of the terminal assembly. The cover may be snapped free along one edge and pivoted upward about the cylindrical bosses of the other edge to expose the terminals or screw heads. However, such covers have had a relatively complex shape which is expensive to provide, and have required attachment surfaces on the terminal which substantially complicate molding shapes and may interfere with convenient use of the assembly.

SUMMARY OF THE INVENTION

An object of the invention is to provide a sectional terminal block which does not require a separate stiffening member or glue, yet is resistant to flexing and cannot be pulled apart.

Another object of the invention is to eliminate critical force-bit plastic-to-plastic fits, while allowing the use of an all-insulating construction except for the actual electrical connection pieces.

Yet another object of the invention is to provide a sectional connector having a low cost cover which allows ready marking of terminal identification and partial removal for access to connection screws.

In accordance with the invention a sectional terminal block is composed of a number of sections, at least whose mating portions are identical, and a contact element holding each corresponding pair of mating portions together. Such a mating pair includes a first section having a longitudinally projecting portion and a contact arm slot for receiving an arm of a contact element inserted transversely to the projecting portion, and a mating second section having a recess for receiving that projecting portion and positioning the two sections transversely with respect to each other, the second section also having a contact slot for receiving an arm of the contact element inserted transversely to that portion, the contact element being arranged so as to engage those slots and thereby to lock the sections together longitudinally with respect to each other.

This invention provides the advantage that each individual section may be formed of a material chosen for optimum insulating, strength and molding properties, without requiring that it have a strong friction grip with an adjoining section, such as by the insertion of a pin into a tight fitting hole. This is true because the sections can be molded accurately at little extra cost using modern techniques, so that they will interlock precisely to provide freedom from motion along two mutually perpendicular axes transverse to the direction of insertion of the sections, or rotation about an axis parallel to the direction of insertion, while accurate location and strength against pulling apart in the direction of insertion are provided by the contact element which may readily be pressed into place so as to lock firmly.

In a preferred embodiment each section has a projecting portion having surfaces for interlocking which are identical to corresponding surfaces on each of the other sections; and each of the sections has identical corresponding interlocking surfaces of a recessed portion. The only differences between the sections relate to their electrical function, not their mechanical interconnection. Further, each pair of adjoining sections is locked longitudinally by a contact element whose arms engage the two mating sections, the mounting and locking surfaces of the contact elements being identical although they may differ in electrical function and configuration. When used as a conventional terminal block, of course, each of the sections and each of the contact elements will be completely identical.

In a further preferred embodiment, each contact element has two arms spaced from each other in the longitudinal direction of the block, and each projecting portion has two correspondingly spaced slots into which respective arms are pressed in a force fit. The recessed portion has one contact slot at the inner end of the recess, through which a contact arm is passed while pressing it into the projecting portion, so that the two sections are rigidly locked together.

In the embodiment of a conventional so-called barrier strip, the slot in the recessed portion adjoins the barrier to one side, and the slot at the base of the same section's projecting portion adjoins the barrier to the other side. In this embodiment the basic contact element is a unitary stamping having a horizontal top surface in which a tapped hole for a contact screw is located, and two parallel extending arms having barbs formed thereon for biting into the edges of the slots in the projecting portion into which they are forced. In a feed-through contact element, the arm which engages the slot at the base end of the projecting portion has a downwardly extending tab which passes through the bottom of the section to permit electrical connection from below the terminal block.

This embodiment of a sectional terminal block offers the advantage that a double row block may have many details similar to those in a single row block; for example, the section may have a central wall separating two recesses, and two identical projecting portions fitting in those recesses, the portions being essentially identical to the projecting portion of the single row embodiment.

To permit attachment of a cover to the barrier strip embodiment, according to the invention it is necessary only that the barrier have a tiny ridge extending longitudinally along the side edge near the barrier top and at least one molded groove in the top edge. The cover itself is then made of a semi-flexible plastic, and may be extruded in relatively long lengths. Preferably short cover lenghts are molded so that only a few connections, for example three, are exposed by pivoting the cover up. Pivoting may simply and reliably be permitted by a longitudinal reduction of cover thickness forming a film-type hinge.

The invention will be described in more detail hereinafter with reference to the embodiments shown in the drawing.

BRIEF DESCRIPTION OF THE DRAWING

FIG. 1 is a perspective view of a double row terminal block according to the invention, cut away to show a portion of a contact element, FIG. 2 is a plan view of a single section for a single row terminal block, FIGS. 3 and 4 are side and end views respectively of the section shown in FIG. 2, FIG. 5 is a perspective view of a contact element for use with the section of FIG. 2, for feed-through connections, and FIG. 6 is an end view of the cover of FIG. 1.

DESCRIPTION OF THE PREFERRED EMBODIMENTS

In FIG. 1 a double row sectional terminal block assembly 1 is shown having the end section cut away so that the interrelationship of the various portions of the sections may be more clearly understood. The assembly 1 is composed of four identical sections 2, adjoining sections being locked together by a dual row contact element 4 shown only partially, and a cover 6.

Each of the identical sections 2 has a pair of projecting portions 8 shaped to be a snug fit in a matching portion 10 having a pair of recesses extending longitudinally to the opposite side from a central barrier 12 of each of the projecting sections 8. Each projecting portion 8 has a top surface 14 having a downwardly extending central hole 15 to allow clearance for the shank of a screw 16, and slots 17 and 18 for arms, not shown in this view, of the contact element 4. The block assembly may be mounted to a panel by a screw passing downward through the hole 15 in the top surface 14 of the projecting portion, the hole preferably having a knock-out plug at its bottom, as described below with reference to FIGS. 2 and 3. The far end of the block assembly is similarly mounted by a screw passing downward through a matching hole (not shown in FIG. 1) in the recessed portion 10 at the far end.

From the foregoing description it is clear that each of the identical sections consist basically of a central portion in which the barrier 12 is formed, a pair of mirror-image projecting portions extending longitudinally in one direction from the central portion, and a recessed portion extending longitudinally in the opposite direction from the central portion, and having symmetrical recesses formed therein matching the projecting portions. The balance of this description is, for simplicity, of a single row terminal block which is generally the same except that each section has only one projecting portion and one recessed portion, adjoining sections being held together by a contact element having only one mounting screw location and only two arms for locking it into the sections.

FIGS. 2, 3 and 4 are different views of the same section arranged so that the various protruding and recessed surfaces by which adjoining sections are interlocked may be most easily recognized and identified. As in the embodiment of FIG. 1, a typical single row terminal block section 20 has a central portion 21, a longitudinally projecting portion 22 extending in one direction from the central portion, and a recessed portion 23 extending in the opposite direction from the central portion 21. In describing these surfaces and the holes in them hereafter, and in the claims, the word "transversely" will be used to refer to any direction which is generally perpendicular to the longitudinal direction defined by the projecting portion and the recess, and the directions horizontal and vertical will refer to the directions when the section is mounted normally on a horizontal plane surface.

To prevent accidental short-circuiting between adjacent electrical contact elements, as by a screw-driver slipping, the center portion 21 includes a vertical transverse barrier 25 extending above a top surface 24 of the recessed portion, a middle area 26 being tapered upwardly from material savings and ease of molding. The barrier 25 has a total width slightly greater than the recessed portion 23, forming a continuation of vertical ribs 28 arranged transversely of the central portion so as to provide, in the fashion known in the art, a greater surface distance between adjacent electrical connections. The topmost side edges of the barrier 25 have a transverse taper 27 and a small sideways-projecting longitudinal rib 29 for retention of a cover strip similar to that described below. Slots 30 are provided for engagement by the cover, the region between the slots and the adjacent taper 27 forming a rigid corner 31 about which the cover can pivot.

The projecting portion 22 has a principal horizontal top surface 33 and principal side surfaces 34 which, as described below, will fit snugly within corresponding surfaces of the recessed portion of an adjoining section. To interlock the sections positively against relative vertical movement at the base end of the projecting portion 22 a pair of shoulder bosses 35 are provided, having a bottom surface 36 extending outwardly from the side surface 34 at a height intermediate the top surface 33 and the bottom of the projecting portion.

As shown most clearly in FIG. 4, to interlock adjoining sections against any relative transverse or twisting movement, the recessed portion 23 has a principal inner top surface 38 and principal inner side surfaces 39 snugly slidable over the corresponding outer surfaces 33 and 34 of a mating projecting portion 22. The recessed portion 23 has a vertical end face 40 which butts against a matching surface 41 on the longitudinal rib 28 of an adjoining section, extending transversely outward from the projecting portion of that section. To provide positive interlocking against motion of the recessed portion relatively upward from the mating projecting portion, a cavity 42 is formed in the end face 40. The cavity 42 has a cross-section and location which permits it to be a sliding fit around the corresponding shoulder boss 35, a bottom surface 43 of the cavity mating under the bottom surface 36 of the shoulder boss. An upper part 44 of the boss 35 engages a groove 45 in the end face 40 for improved locking against twisting or bending stresses.

From the foregoing description it will be clear that the external surfaces of the projecting portion and the internal surfaces of the recessed portion interlock against any relative transverse motion of two adjoining sections, or any relative twisting motion about a longitudinal axis. To provide complete rigidity and strength of an assembled terminal block, transverse contact slots 46 and 47 are formed, in line with each other when a projecting portion is fully pushed into a recessed portion, the slot 46 extending vertically downward from a recessed top surface 48 of the recessed portion, downward through the principal inner top surface 38 at the base end of the recessed portion adjoining the central portion. The slot 47 is formed by a downwardly extending cavity from the top surface 33 of the projecting portion. The slot 47 has cross-section dimensions which are an interference fit with an arm of a contact element to be described below. In order that a contact element such as one side of that shown in FIG. 1 be securely retained, an open sided slot 49 is formed at the outer end of the recessed portion 23, extending downward from the top surface 48, and a matching slot 50 is formed as a cavity extending downward from the top surface 33 of the projecting portion 22, adjoining the barrier 25 of the central portion 21, the slot 50 preferably having the same cross-section as the slot 47.

Further, to provide clearance for the downwardly projecting portion of a terminal screw in a contact element, and for passage of a mounting screw where either the projecting or recessed portions is the extreme portion of an assembled terminal block, hole 52 is provided in the top surface of the recessed portion and a matching hole 53 is formed as a downwardly extending cavity from the top surface 33 of the projecting portion. To provide electrical insulation from a metallic panel on which the section might be mounted, the cavities 47, 50 and 53 preferably do not extend through the bottom of the projecting portion; however an annular notch 54 shown by dashed lines in FIG. 4 is preferably provided so that the bottom 55 of the cavity 53 may readily be knocked out where a feed-through connection or passage of a mounting screw is desired. Further, to permit the positioning of a feed-through tab where this is provided on a contact element, a slot 56 is preferably provided extending longitudinally between the screw cavity 53 and the slot 47 in the projecting portion. A mating slot 57 interconnects the hole 52 and slot 46 in the recessed portion.

To provide increased electrical creepage distance, the recessed top surface 48 in the top of the recessed portion is concentric with the hole 52, and is slightly larger than the contact element. The contact element thickness of course is made greater than the recessed surface depth. Further, to avoid pressure where a radius exists at the junction of a contact element arm and the flat major portion of the contact element, a chamfer 59 is provided at the top edge of the slots 46 and 49 toward the screw hole 52.

It will be clear that the section 20 may be made of any insulating material having adequate mechanical properties. A good combination of strength and rigidity is obtained by molding from a polyester plastic. Of course, other materials having selected properties may be used, and it is not necessary that the section be formed by molding.

The single row terminal contact shown in FIG. 5 is particularly adapted for locking together identical sections of the sort shown in FIG. 2. The contact element 70 is preferably stamped to shape, and is made of a moderately hard conducting material such as brass, covered by any well-known anti-corrosive plating as is desired. The basic portions of the contact element 70 have the shape of an inverted U. A top surface 71, as viewed from above, has a generally circular shape matching the shape of the recessed surface 48 of the recessed portion 23 of the section 20. To provide good electrical contact and firm mechanical holding of a wire or other device that may be held against the top surface, a series of serrations 72 are preferably formed in the top surface, extending in the longitudinal direction of the terminal block assembly as the contact element would be installed. At the center of the top surface a hole 74 is formed, for example by punching and drawing material downward from the plate of material out of which the contact element is formed. In the most common type of terminal assembly this hole is tapped to form threads for holding a screw.

At each longitudinal end of the contact element an arm 76 is bent vertically downward for engaging the slots 46, 47 and 49, 50 of the respective sections being held together by the contact element. The upper part 77 of each arm preferably has a rectangular cross-section so as to be a snug fit in the slot 46. Below the upper part 77, notches 78 are formed in the two edges of each arm, to provide relief so that the barbed portion 79 below will bite lockingly into the surfaces of the slots 47 and 50 in the projecting portion 22 of the corresponding section. In the preferred embodiment shown in FIG. 5, three barbs are provided on each arm. The two edges 80 are tapered below the notches 79, so as to form barbed points 81 at the corner by each of the notches. In addition, a tag 83 is stamped into the lower central portion of each arm, the metal along the top edge 84 and upper side edges 85 of the tag being sheared so that part of the upper edge 84 projects inwardly from each of the two arms. The inwardly extending edge 84 therefore provides an additional surface that bites into the material from which the plastic section 20 is molded so as to resist loosening or pulling out of the contact element.

To provide a feed-through connection, one form of contact element is shown having a shank 87 extending below and offset from the bottom of one of the arms 76. Preferably the shank is centered below the hole 74, so that by removing the bottom 55 of the cavity 53 in a section 20 the shank can protrude downwards.

The method of assembly of a terminal block assembly as described above is extremely simple. Two sections are aligned longitudinally with respect to each other, and the projecting portion (portions, if a multiple row terminal block such as FIG. 1 is being assembled) is inserted into the corresponding recessed portion of the adjoining section, until the end face 40 of the recessed portion is butted tightly against the face 41 of the central portion of the other section. By transverse movement of the contact element 70, its arms are moved through the slots 46 and 49 and pressed into the slots 47 and 50 in the projecting portion with an interference barbed fit so that the contact element cannot be removed easily or nondestructively. After the contact element has been inserted (for example by use of an arbor press or pliers having jaws designed for the purpose) basic assembly is complete.

Many different styles of connection can be applied to the same basic contact element; for example, instead of a plain screw a pressure contact sleeve with locking screw may be used. In many or most cases the basic contact element is provided without the feed-through shank, and as in FIG. 1, the multiple row blocks seldom involve feed-through contact elements of the sort shown in FIG. 5. The top surface of the contact element may extend higher and be more complex. As an example, a pressure contact sleeve may be provided nestling between the upper portions of the arms of the U-shaped contact, the lower part of the sleeve being pressed tightly against the top surface of the plastic section 20.

As discussed above, it is often desirable to provide a cover for a barrier strip such as that shown in FIG. 1. In a preferred embodiment of the barrier strip according to the invention, the barriers between the contact areas, such as the barriers 12 and 25, include means for removably attaching a cover without obstructing access to the contact elements or requiring mounting surfaces which are difficult or nearly impossible to mold. As shown in FIG. 6, the cover 6 is a simple one-piece construction having provision for identification markings or a marking strip, and permitting pivotal movement from the cover down position to gain access readily to one side or the other of the terminal block.

The cover 6 is symmetrical about a center line, and consists basically of a central part 90, two hinge strips 91, and gripping portions 92 extending longitudinally along each edge of the cover. The gripping portion 92 has an outer lip 94 projecting downwardly below the level of the central part 90, and having a notch 95 extending along the inner edge of each lip near the bottom. Extending downwardly from the gripping portion 92, parallel to each lip 94, is a rib 97 which in the preferred embodiment has generally parallel sides, the lip 94 and rib 97 defining a space 98 between them generally the same shape as the rigid corner 31 of the barrier in the embodiment of FIGS. 2–4.

The hinge strip 91 has a thinner wall section than the rest of the cover, shaped as a hollow semi-cylinder extending upwardly between the gripping portion 92 and the central part 90. To provide greater flexibility, a shallow groove 99 is formed in the top of the hinge portion, extending longitudinally along the length of the cover.

To provide a slot for an identification strip, a pair of inwardly facing guides 100 are spaced to each side of the longitudinal center line, each guide consisting of an upwardly extending rib 101 and an overhanging inwardly extending flange 103. The space under and between the flanges 103 is shaped for receiving a card or strip of paper on which the identification of the different contact elements may be printed.

For optimum strength and attractive appearance the cover may be made of a moderately resilient plastic such as polypropylene. Further, to allow temporary marking without the use of a removable strip, the top surface 105 of the central part 90 between the ribs 101 may have a matte finish, thus allowing pencil markings to be made on the plastic. The guides 100 provide protection against accidental erasure of the marking by a user's fingers.

As described thus far the cover may be made readily by an extrusion process, in long lengths which may be cut to suit the particular number of sections that are assembled in a particular terminal block. Installation of such a cover is simple, because the rib 97 slides into a slot such as the slot 110 shown in FIG. 1, or in the case of a single row terminal block the slot 30 shown in FIG. 4, while the outer lip 94 fits over a surface such as the transverse taper 27 shown in FIG. 4, the notch 95 engaging a longitudinal rib such as the rib 29 of FIG. 4. It will be clear that pivoting of the cover so as to obtain access vertically to the terminals is easy by simply pressing upwardly on either overhanging lip 94 so as to disengage the resilient plastic cover from the matching rib, and pivoting that entire side of the cover upward about the groove 99 and hinge strip 91 at the other side of the cover.

In a preferred embodiment which offers the advantage that it is easy to pivot the cover upwardly for only three terminals at a time, thus providing protection to other terminals and requiring less force for pivoting the cover, rather than being supplied as an extrusion the cover is a molded part having a length equal to the distance between the centers of the barriers at the extreme end of three sections. To position this short component longitudinally, a longitudinally extending boss 108 is provided extending downwardly from each outer edge of the central part 90, adjacent the hinge strip 91. The boss 108 has a length which is only slightly less than that of the distance between the facing surfaces of the vertical ribs 28 on adjoining sections. Thus, in the preferred symmetrical construction, the boss 108 extends for approximately the central one-third of the length of the cover 6. This short cover can be easily pivoted from either side; and different covers on a long block can be pivoted in opposite directions.

While maintaining the spirit and all of the advantages of the invention, many other combinations are possible. For example, the individual sections need not be identical. Extra length sections can be made with special functions such as mounting a fuse. At least one end of the fuse clip may be a contact element with downwardly extending arms for engaging the slots 46, 47, 49 and 50. All that is necessary is that there be a standard projecting portion at one end and a recessed portion at the other, with facility for mechanical locking by arms forming part of the contact element. In another embodiment, in a dual row block assembly each end of a section may have one projecting portion and one recessed portion, like portions being aligned diagonally with respect to each other so that a section can be turned either way (viewed from above) before inserting it into the adjoining section. Similarly, in some applications it may be preferable that both ends of certain sections have projecting portions or have recessed portions, especially where a section is elongated so as to carry on it a device such as a fuse holder, and the section is not symmetrical at its ends. It would then be possible to insert the special section turned either way, according to the desired application, so long as only one subsection is used in a particular block assembly, or so long as an equal number of other sections are made with both ends alike, but of the opposite type.

To provide maximum strength and rigidity, with minimum use of plastic material, the side walls forming the recessed portion may be very thick but hollow, with cavities formed therein while molding. Such a pair of symmetric cavities are shown by dashed lines in FIGS. 2–4. Also, in the embodiment described in detail, the principal recess in the recessed portion must extend somewhat into the central portion (between the side ribs 28) to allow room for a wall of material between the slot 47 in the projecting portion and the extreme or distal end of that portion. If, on the other hand, the slots do not adjoin the barrier or central portion, but rather are some small distance remote from the central portion, then the recess need not extend so far.

Where a barrier type strip is used, the upper portion of the barrier may have many different forms, and other shapes may be used for retaining a cover strip. All that is necessary is that the barrier have a relatively rigid corner to opposite sides of which the longitudinal lip and rib of the gripping portion may extend.

While there are advantages in making the barriers and covers symmetrical, it is also possible to provide only one hinge portion on the cover, especially if a narrow section has a barrier on which it is difficult to provide two rigid corner sections with grooves for the longitudinal rib of the cover. In such a case the hinge and rib may be omitted from one edge of the cover, and the lip on that edge may be omitted if less reliable holding of the cover closed is acceptable.

The configuration and detailed description of the terminal block given above are preferred where a relatively high strength, stable molding resin such as a polyester material is used. Many detailed variations of the particular configuration described above are possible within the spirit of the invention, and may be advantageous if different types of material are used for the contact elements or the sections.

For example, it may be desirable to provide a terminal block with very high temperature resistance, or resistance to atomic or other radiation. Materials chosen with special characteristics such as these may be far more brittle than the synthetic molding materials normally used for barrier strips, and as a result an interference fit by a barbed contact element would not be reliable. In such a case a contact element may be used having an arm whose lower part projects through the top of the projecting portion and is bent or twisted below that surface. In such a case the bottom of the projecting portion would be left open to provide clearance for introduction of a tool to bend or otherwise lock the contact element arm.

The longitudinally projecting portion and the recess portion do not need to have rectangular cross sections, or identical cross sections at any or all longitudinal stations. For example, vertically tapering sections may be used for molding relief or to provide a jam fit when the contact arm is locked in place. Also, at some longitudinal stations, only certain male and female surfaces may be aligned, with clearance between other surfaces, and at some stations there may be no contact between the projection and recess cross sections because of relief to reduce the amount of material used.

We claim:

1. A sectional terminal block comprising a plurality of sections and at least one contact element having two arms, wherein a first section includes a longitudinally projecting portion having a pair of contact arm slots for receiving the arms of said contact element inserted transversely to said portion, a second section includes recess means for receiving said projecting portion and positioning said sections transversely with respect to each other, and a contact slot for receiving one arm of said contact element inserted transversely to said portion, and said contact element is arranged so that said one arm passes through the slot in the second section and is locked in one slot in said projecting portion and the other arm is locked in the other slot of said projecting portion to lock said sections longitudinally with respect to each other.

2. A sectional terminal block as claimed in claim 1, wherein said contact element comprises a unitary conductive metal stamping having a top surface, the two arms being longitudinally spaced and bent downward from said top surface, the arms comprising barbed means for engaging respective slots in the projecting portion, and the top surface including means for making electrical connection thereto.

3. A sectional terminal block as claimed in claim 2, wherein said first section projecting portion has two contact slots extending parallel to each other, a through hole extending intermediate and parallel to said slots, and a longitudinal slot extending between said hole and at least one of said contact slots; and said contact element includes a feed-through shank extending from the distal end of one of said arms in a direction parallel to the direction of contact element insertion, said shank having a part offset from said one arm so as to project from the terminal block through said hole.

4. A sectional terminal block comprising a plurality of identical sections and at least one contact element having an arm, wherein said identical sections each include a projecting portion extending longitudinally in one direction, and a recessed portion extending longitudinally in the opposite direction, each of said portions having a contact arm slot for receiving an arm of said contact element inserted transversely, the projecting portion of a first identical section projects into the recessed portion of a second, adjoining identical section, the arm received in said slot in a projecting portion is an interference fit in said slot so as to lock said arm in said slot, and said contact element locks said sections longitudinally with respect to each other.

5. A sectional terminal block as claimed in claim 4, wherein said recessed portion has a given internal cross-section at one longitudinal location at least, and said projecting portion has a matching external cross-section at a corresponding longitudinal location when the sections are interlocked, such that said cross-sections locate said sections transversely with respect to each other.

6. A sectional terminal block as claimed in claim 4, wherein said identical sections include a central portion having a vertical extending barrier, the slot in the recessed portion adjoining said barrier, the arm of the contact element received in the slot in the second section recessed portion extending downward into said slot in the projecting portion of the first section.

7. A sectional terminal block as claimed in claim 6, wherein each identical section projecting portion has two longitudinally separated slots, and said contact element has first and second longitudinally separated arms locked in respective projecting portion slots, the first of said arms being the arm engaging the slot in the recessed portion.

8. A sectional terminal block as claimed in claim 7, wherein the second of said arms has a downwardly extending feed-through tab formed integrally therewith, said tab extending downwardly below said projecting portion and adapted for electrical connection.

9. A sectional terminal block as claimed in claim 6, wherein said identical section recessed portions each have a top wall and two side walls defining the recess, said top wall having a longitudinally extending opening therethrough extending from said slot away from the barrier to a hole extending parallel to the contact element insertion direction, said hole and top wall being adapted to receive a screw downwardly therethrough for mounting the terminal block.

10. A sectional terminal block as claimed in claim 9, wherein said contact element has a second arm spaced longitudinally from said arm received in the recessed portion slot, and lockingly engaged in a second slot in the mating projecting portion; and a feed-through shank extending from the first arm, said shank having a portion offset from the first arm and projecting from the block through said through opening.

11. A sectional barrier strip assembly comprising at least four identical sections made of an electrically insulating material, each section including a central portion and having a vertically extending transverse barrier, each barrier having a top edge and two top corners, and respective longitudinally extending grooves through the top edge adjacent the corners; a projecting portion extending from the central portion in one longitudinal direction; and a recessed portion extending from the central portion in the other longitudinal direction, each projecting portion having two longitudinally spaced vertical transverse contact arm slots, and a plurality of longitudinal external alignment surfaces, each recessed portion having a cross-section adapted to receive one of the projecting portions and a plurality of longitudinal internal alignment surfaces matching said external alignment surfaces, said sections being interlocked against relative transverse movement by engagement of three of the projecting portions into the recessed portion of an adjacent section, the recessed portions having slots aligned with the slots in the projecting portions, at least three contact elements, each element having two arms, the arms of each element being inserted into the respective slots of a respective recessed portion and projecting portion lockingly engaged therein, and a cover removably fitted over said barriers, said cover having a central part, and symmetric gripping portions and hinge means, each gripping portion having a longitudinal outer lip and a rib extending downward and fitting around the barrier corners, the lip and respective barrier having resilient means for holding against upward movement, said hinge means being formed integrally with the cover between the gripping portion and the central part.

12. An assembly as claimed in claim 11, wherein said cover is a unitary part molded from a semi-flexible plastic material, said hinge means being molded as a wall section thinner than the gripping portion and the central part.

13. An assembly as claimed in claim 12, wherein said central part includes a longitudinal locating rib extending downward, said locating rib having a length parallel to the distance between adjacent barriers, the cover being longitudinally symmetrical and having a length equal to the distance between centers of the end barriers in a strip formed of four sections.

14. A barrier strip assembly having a pivotal cover, comprising a terminal block having a plurality of contact elements mounted therein and spaced longitudinally from each other, and a plurality of barriers located between adjacent contact elements and extending transversely outward;

each barrier having a distal end having two corners, and a longitudinally extending groove through said end adjacent one of said corners, adjacent barrier ends, corners and grooves being aligned longitudinally; and said cover comprising a central part, a gripping portion and longitudinal hinge means, said gripping portion having a longitudinal outer lip and a rib generally parallel to each other and defining a space therebetween generally the same cross-section as said one barrier corner, said hinge means being formed integrally with the cover between the gripping portion and the central part.

15. An assembly as claimed in claim 14, wherein said rib fits snugly in said groove, said lip has a longitudinal notch on its inner face, and the barrier corner has a transversely projecting rib which engages the notch in the lip.

16. An assembly as claimed in claim 14, wherein said cover is molded from a semi-flexible plastic material, said hinge means being formed as a wall section thinner than the gripping portion and the central part.

17. An assembly as claimed in claim 16, wherein the central part includes a longitudinal locating rib extending generally parallel to the lip and rib of the gripping portion, said locating rib having a length equal to the distance between adjacent barriers.

18. An assembly as claimed in claim 17, wherein said cover has a length equal to the center-to-center distance between the barriers at the extreme end of three sections, and said cover is longitudinally symmetrical.

19. An assembly as claimed in claim 14, wherein each barrier has two symmetrically arranged grooves defining symmetric corners, each corner having means for retaining a cover lip against pivotal opening of the cover; and the cover is symmetric about its longitudinal center line, and is formed from a semi-flexible plastic material, each said hinge means being formed as a wall section thinner than the gripping portions and the central part.

20. An assembly as claimed in claim 14, wherein said central part has longitudinal means for retaining an identification strip, said central part includes a surface prepared for direct marking on the cover, and said means for retaining is arranged to provide physical protection against accidental erasure of a direct marking on said surface.

21. A sectional terminal block comprising at least two terminal sections, one of said sections having a longitudinally extending recess and a transversely extending slot opening into said recess and the other of said sections having a mating, longitudinally projecting portion extending into said recess and positioning said sections transversely with respect to each other, said projecting portion having a transversely extending slot aligned with said slot in said one section, and at least one contact element arranged on said one section and having an arm which passes through said slot in said one section and extends into and lockingly engages said slot in said other section firmly securing said element to said one section and locking said sections longitudinally with respect to each other.

* * * * *